US012654094B2

(12) United States Patent
Williams, Jr.

(10) Patent No.: US 12,654,094 B2
(45) Date of Patent: Jun. 16, 2026

(54) BALLOON NOZZLE ADAPTOR CONNECTOR SYSTEM

(71) Applicant: James Eddie Williams, Jr., Miami, FL (US)

(72) Inventor: James Eddie Williams, Jr., Miami, FL (US)

( * ) Notice: Subject to any disclaimer, the term of this patent is extended or adjusted under 35 U.S.C. 154(b) by 187 days.

(21) Appl. No.: 18/536,903

(22) Filed: Dec. 12, 2023

(65) Prior Publication Data

US 2025/0186898 A1 Jun. 12, 2025

(51) Int. Cl.
*A63H 27/10* (2006.01)
*A63F 9/00* (2006.01)

(52) U.S. Cl.
CPC ..... *A63F 9/0079* (2013.01); *A63H 27/10* (2013.01); *A63F 2009/0084* (2013.01); *A63H 2027/1041* (2013.01); *A63H 2027/1083* (2013.01)

(58) Field of Classification Search
CPC ..... A63H 27/10; A63H 2027/1033; A63H 2027/1041; A63H 2027/1083; A63F 9/0079; A63F 9/14; A63F 2009/0084
USPC ..... 446/220, 221, 222; 273/445, 458
See application file for complete search history.

(56) References Cited

U.S. PATENT DOCUMENTS 1,098,303 A * 5/1914 Steiner et al. ..... G09F 19/08 446/197
1,231,251 A * 6/1917 Graham ..... A63F 7/066 273/119 B
1,368,115 A * 2/1921 Chester ..... A63F 9/0079 273/445
1,394,277 A * 10/1921 Chester ..... A63F 9/14 273/445
1,410,371 A * 3/1922 Chester ..... A63F 9/0079 273/445
1,421,238 A * 6/1922 Hulsmann ..... A63F 9/0079 273/445
1,437,261 A * 11/1922 Nagle ..... A63G 31/00 472/134
1,544,452 A * 6/1925 Haner ..... A63F 9/14 463/64
1,556,984 A * 10/1925 Wolkenhauer ..... A63F 9/14 273/458
2,636,315 A * 4/1953 Morsch ..... A63H 33/00 446/187
2,924,041 A * 2/1960 Jackson et al. ..... A63H 27/10 446/224
3,092,388 A * 6/1963 Wagenheim ..... A63F 9/0204 273/380

(Continued)

FOREIGN PATENT DOCUMENTS

GB 190621 A * 12/1922 ..... A63F 9/14

OTHER PUBLICATIONS

Boom Blaster | Water wars. (n.d.). Retrieved Dec. 12, 2023, from https://waterwars.com/portable-models/boom-blaster/.

*Primary Examiner* — Alexander R Niconovich

(57) ABSTRACT

A balloon bursting frame apparatus is provided so as to have a plurality of outlet nozzles, each outlet nozzle operatively associates with an inlet of a balloon by way of a preloaded adaptor. The preloaded adaptor provides a barbed conduit with raised flanges that define a lock groove to which a retainer ring of connection mechanism can snap-connect to. The connection mechanism also provides a cable tie for cinching the inlet of the balloon securely in place.

1 Claim, 4 Drawing Sheets

(56) References Cited

U.S. PATENT DOCUMENTS 3,161,998 A * 12/1964 Lennox ..... A63H 27/10 53/79
3,336,030 A * 8/1967 Martell ..... A63G 31/007 273/349
3,405,941 A * 10/1968 Martell ..... A63F 9/0243 273/349
3,685,825 A * 8/1972 Dorazio ..... A63F 9/0079 273/458
3,994,324 A 11/1976 Zeyra
4,171,806 A * 10/1979 Goldfarb ..... A63H 33/00 273/458
4,201,387 A * 5/1980 Revermann ..... A63F 3/00006 273/243
4,243,220 A * 1/1981 Shelley ..... A63F 9/0079 273/458
4,538,817 A * 9/1985 Ramella ..... A63F 9/0204 446/61
5,033,256 A 7/1991 Rupp
5,324,045 A * 6/1994 Trawick ..... A63F 9/0079 251/303
5,439,199 A * 8/1995 Briggs ..... F16K 21/04 251/324
5,496,203 A 3/1996 Murray
5,588,896 A * 12/1996 Goodman ..... A63H 27/10 446/187
6,402,582 B1 * 6/2002 Sherer ..... A63H 27/10 273/458
6,478,057 B1 11/2002 Bearss et al.
6,488,557 B1 * 12/2002 Elliott ..... A63H 27/10 446/224
7,134,665 B2 * 11/2006 Holsten ..... A63F 9/00 273/458
7,487,972 B2 * 2/2009 Halliburton ..... A63F 7/027 273/458
8,132,599 B2 3/2012 Crandell et al.
8,714,555 B1 * 5/2014 Kelsey ..... A63F 9/0079 273/458
8,783,001 B2 * 7/2014 Sikorcin ..... A63H 27/10 53/558
9,713,775 B2 * 7/2017 Cogliandro ..... A63H 5/04
9,731,213 B2 * 8/2017 Laden ..... A63H 27/10
10,500,516 B1 * 12/2019 Macias-Castillo ..... A63H 27/10
12,121,825 B1 * 10/2024 Zhang ..... A63H 3/06
2005/0209674 A1 9/2005 Kutscher et al.
2006/0232014 A1 * 10/2006 Holsten ..... A63H 37/00 273/458
2008/0121309 A1 * 5/2008 Boise ..... A63H 27/10 141/313
2009/0050834 A1 2/2009 Boise et al.
2009/0050835 A1 2/2009 Boise et al.
2018/0036646 A1 * 2/2018 Dixon ..... A63H 27/10
2018/0272242 A1 * 9/2018 Watson ..... A63H 3/52
2022/0212095 A1 * 7/2022 Caiola, III ..... A63F 9/0079
2022/0387901 A1 * 12/2022 Perrin ..... A63H 27/10

* cited by examiner

BALLOON NOZZLE ADAPTOR CONNECTOR SYSTEM

BACKGROUND OF THE INVENTION

The present invention relates to balloon-bursting games and, more particularly, to a balloon bursting frame apparatus providing preloaded balloon nozzle adaptor attachments for enabling a multiple balloon-bursting game.

At celebratory events and parties, balloon-bursting games provide amusement to individuals. Current balloon-bursting games, however, leave a lot to be desired because they are designed for one user per unit, meaning they provide only one balloon nozzle per apparatus, which results in several drawbacks. These drawbacks include limiting the number of participants, lack of variety or challenge, minimum interaction, and socialization with others, and it may quickly become boring.

Existing balloon-bursting games are flawed in other ways, such as presenting safety risks when sharp, piercing members are used with balloon bursting games. The most common problem for existing balloon pop bursting games, however, is reloading and replacing a new balloon on the nozzle in a timely manner for the next participant to play. Taking too long to reload and replace a new balloon have the following disadvantages: taking away the fun of the game as participants will be stuck waiting for the next balloon to be ready, leading to a decrease in the number of participants due to the long wait time, making gameplay less exciting, and the participants becoming bored.

Furthermore, existing balloon pop bursting games are made with small nozzles, and it is quite common for balloons to slip off before they can reach their capacity to burst, leading to the following disadvantages: causing a great deal of frustration when trying to burst the balloon because the participants have to constantly reattach the balloon to the nozzle, which can be quite tedious; and causing pressurized air inside of the balloon leaking out in an uncontrolled manner, leading to a failed attempt at bursting the balloon.

As can be seen, there is a need for a multiple airway balloon bursting frame apparatus providing preloaded balloon nozzle attachments.

SUMMARY OF THE INVENTION

This innovative invention addresses the challenges associated with traditional balloon burst toys by introducing a preloaded balloon nozzle adaptor and an enhanced balloon bursting game apparatus that allows for efficient and simultaneous participation of multiple users. The preloaded balloon nozzle adaptor simplifies the process of reloading balloons onto the nozzle, while the frame apparatus with its integrated airway pipelines, sockets, and inflatable pumps revolutionizes the overall experience of balloon bursting games. The present invention offers a comprehensive and practical solution that promises to elevate the enjoyment of balloon-related activities.

The present invention facilitates the concurrent engagement of multiple participants, introducing a new dimension of enjoyment and thrill, especially for enthusiasts of competition and collaborative team gameplay. A notable feature of this innovation is the incorporation of the preloaded balloon nozzle adaptors, which streamline the process of replacing balloons and significantly reduce downtime. This seamless balloon replacement mechanism contributes to an elevated overall experience, infusing the activity with increased amusement and excitement.

The present Invention improves the following issues and problems previously mentioned with existing balloon bursting games: (a) the present invention enables a multi-balloon bursting frame apparatus that allows multiple participants to burst balloons simultaneously, thereby enhancing the overall experience that adds fun and excitement for those who like to compete or like team-play; (b) the preloaded balloon nozzle adaptor obviates the long wait time for the next balloon to be installed is by allowing a new balloon adaptor to be plugged into the balloon bursting frame apparatus in a matter of seconds, thereby eliminating the need for manual reloading on the small nozzle and allows participants to spend more time playing and less time waiting; (c) the preloaded balloon nozzle adaptor also prevents balloons slipping off the nozzle because of the novel connection mechanism, and as a result replacement balloons are "loaded" beforehand, and it can be replaced in a matter of seconds; (d) the balloon bursting frame apparatus is raised off the ground with two wide leg stands with a hinge pin bracket frame; (e) the present invention eliminates the possibility of participants cutting, poking, or scratching themselves by refraining from using sharp agents to burst the balloons; and (f) the present invention allows employment of basic inflatable pumps that need only fluidly connect to the balloon bursting frame apparatus with no special equipment to compress air.

The present invention embodies a preloaded balloon nozzle adaptor that allows for a new balloon to be plugged into the balloon bursting frame apparatus in a matter of seconds through providing a barb sleeve designed to securely attach to a balloon, wherein a raised first flange positioned midway around the barbed sleeve serves as an abutment for the end tube socket, and a smaller, second flange located above or below the raised flange, which operatively associates with an arcuate retainer of the connection mechanism of the preloaded balloon nozzle adaptor.

The present invention embodies a connection mechanism dimensioned and adapted to interlock between the raised first and smaller second flanges. The connection mechanism may include a cable tie and valve strap combination with a release mechanism.

The present invention embodies a balloon bursting game apparatus having a frame apparatus equipped with a plurality of airway pipelines, wherein each airway pipeline has an end bracket and a balloon socket positioned on each pipeline along the top section of the frame apparatus, intended to securely hold the preloaded balloon nozzle adaptors. An airway socket located at the bottom of the each airway pipeline is dimensioned and adapted to connect with an external airline tubes. Each airline tube is operatively associated with an inflation pump. A circular base provides stable support for the entire frame apparatus.

The present invention may embody a game apparatus leg stands with hinge pin inserts.

In one aspect of the present invention, a balloon bursting apparatus frame includes a plurality of outlet nozzles, each configured to fluidly couple with an inlet of a balloon.

In another aspect of the present invention, the balloon bursting apparatus frame further includes the following: an inlet nozzle fluidly coupled to each outlet nozzle; a pump fluidly coupled to each inlet nozzle, respectively, by way of a conduit; an adaptor dimensioned and shaped to removably attach to each outlet nozzle, wherein each adaptor comprises a conduit have a barbed exterior; and a first flange spaced apart from a second flange, wherein each flange connects to and is raised beyond the barbed exterior so as to define a lock groove; and a connection mechanism having a cable tie from which an arcuate retainer dimensioned and sized to snap into the lock groove, wherein each connection mechanism has a release mechanism for moving the cable tie to an unlocked condition from a locked condition about the inlet of the balloon it operatively associates with.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a balloon bursting frame apparatus having a plurality of outlet nozzles, each outlet nozzle operatively associates with an inlet of a balloon by way of a preloaded adaptor. The preloaded adaptor provides a barbed conduit with raised flanges that define a lock groove to which a retainer ring of connection mechanism can snap-connect to. The connection mechanism also provides a cable tie for cinching the inlet of the balloon securely in place.

Figure 1:
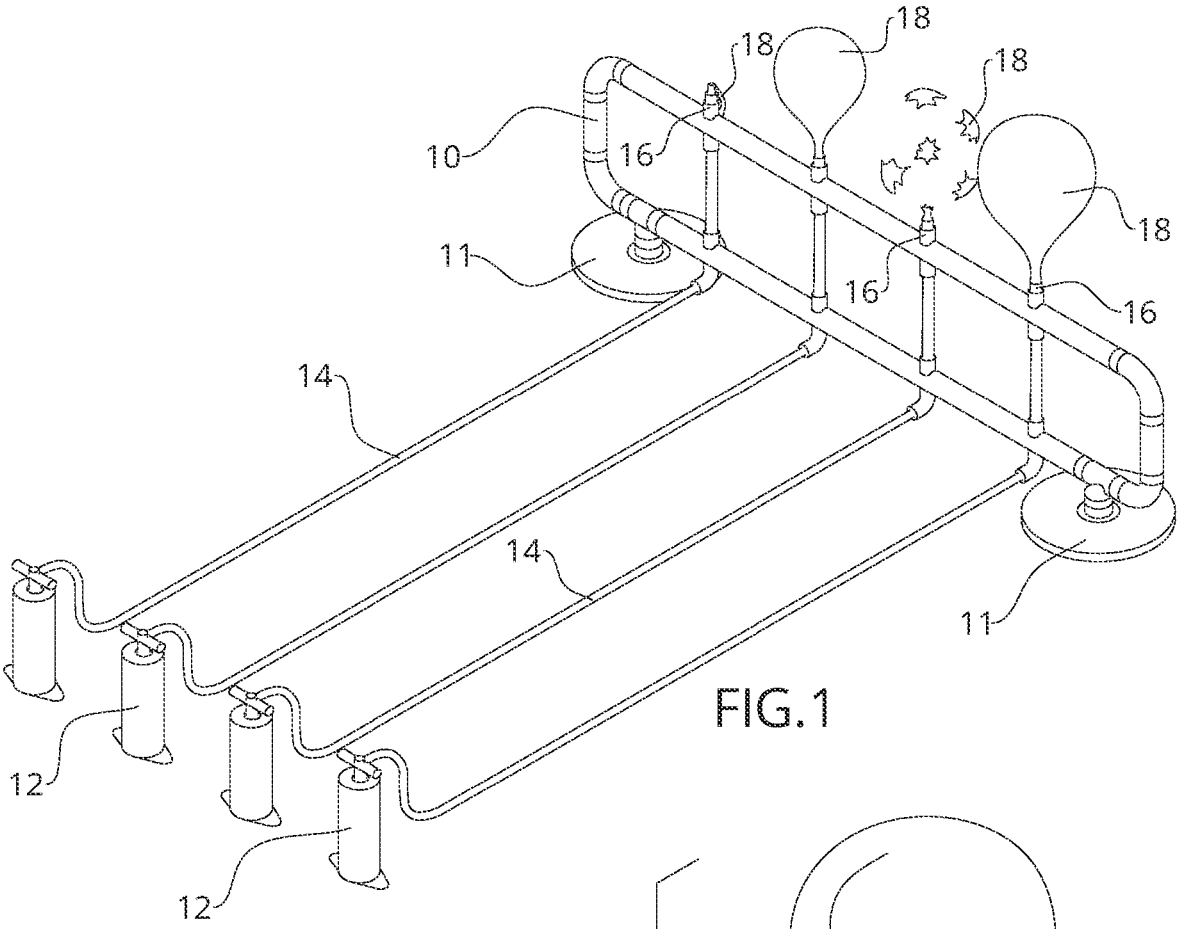
FIG. 1 is a perspective view of an exemplary embodiment of the present invention, shown in use.
Figure 2:
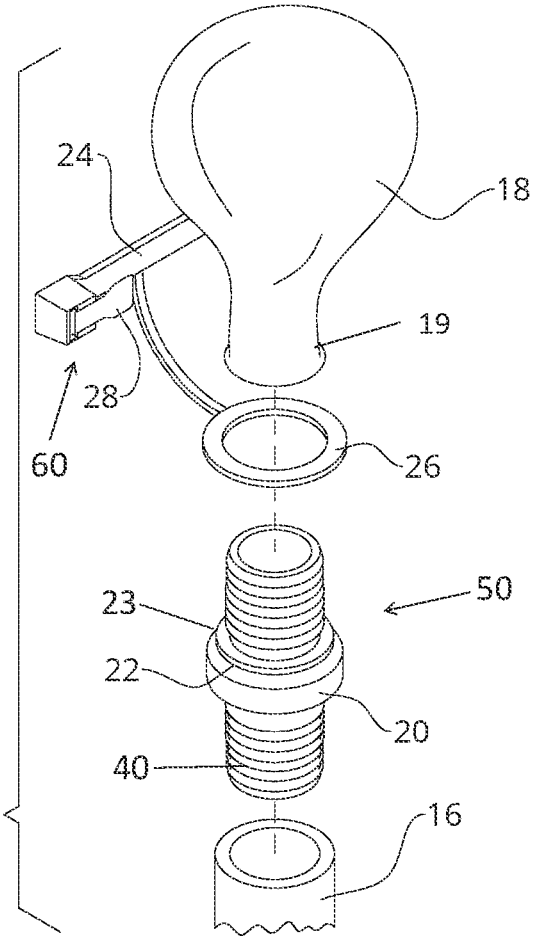
FIG. 2 is an exploded view of an exemplary embodiment of a quick-change attachment of the present invention.
Figure 3:
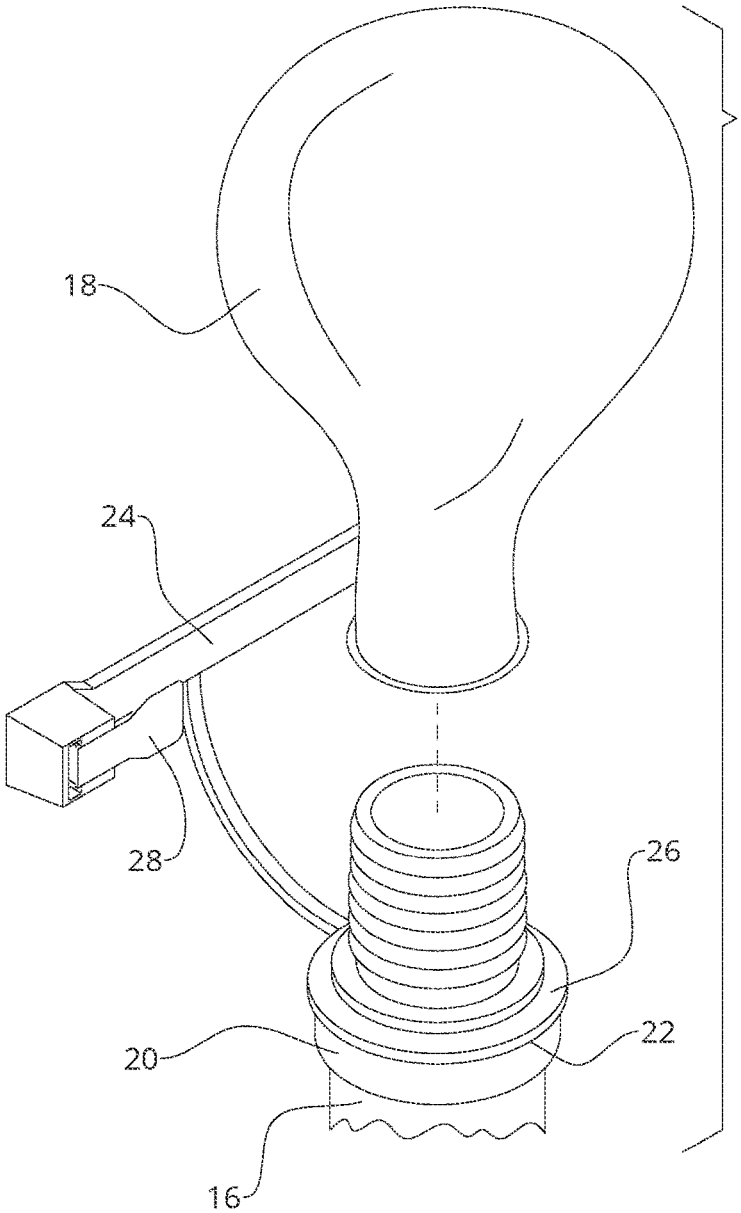
FIG. 3 is a detailed exploded perspective view of an exemplary embodiment of the quick-change attachment of the present invention in an unlocked condition.
Figure 4:
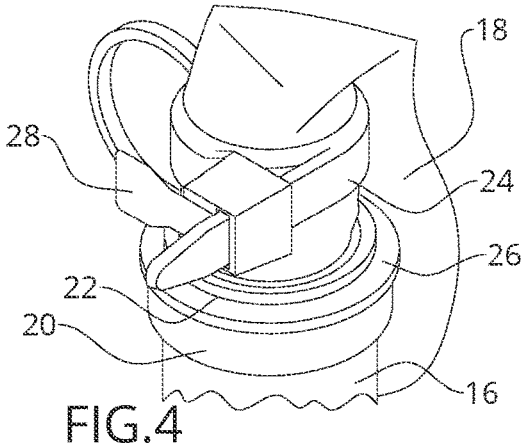
FIG. 4 is a detailed perspective view of an exemplary embodiment of the quick-change attachment of the present invention in a locked condition.
Figure 5:
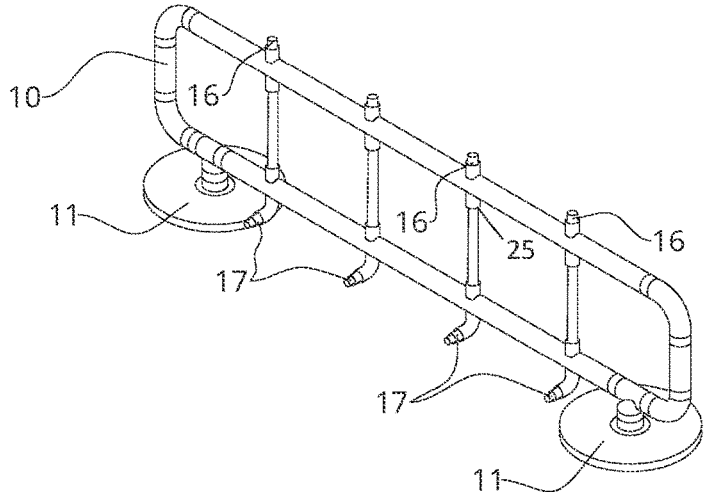
FIG. 5 is a perspective view of an exemplary embodiment of a frame of the present invention.
Figure 6:
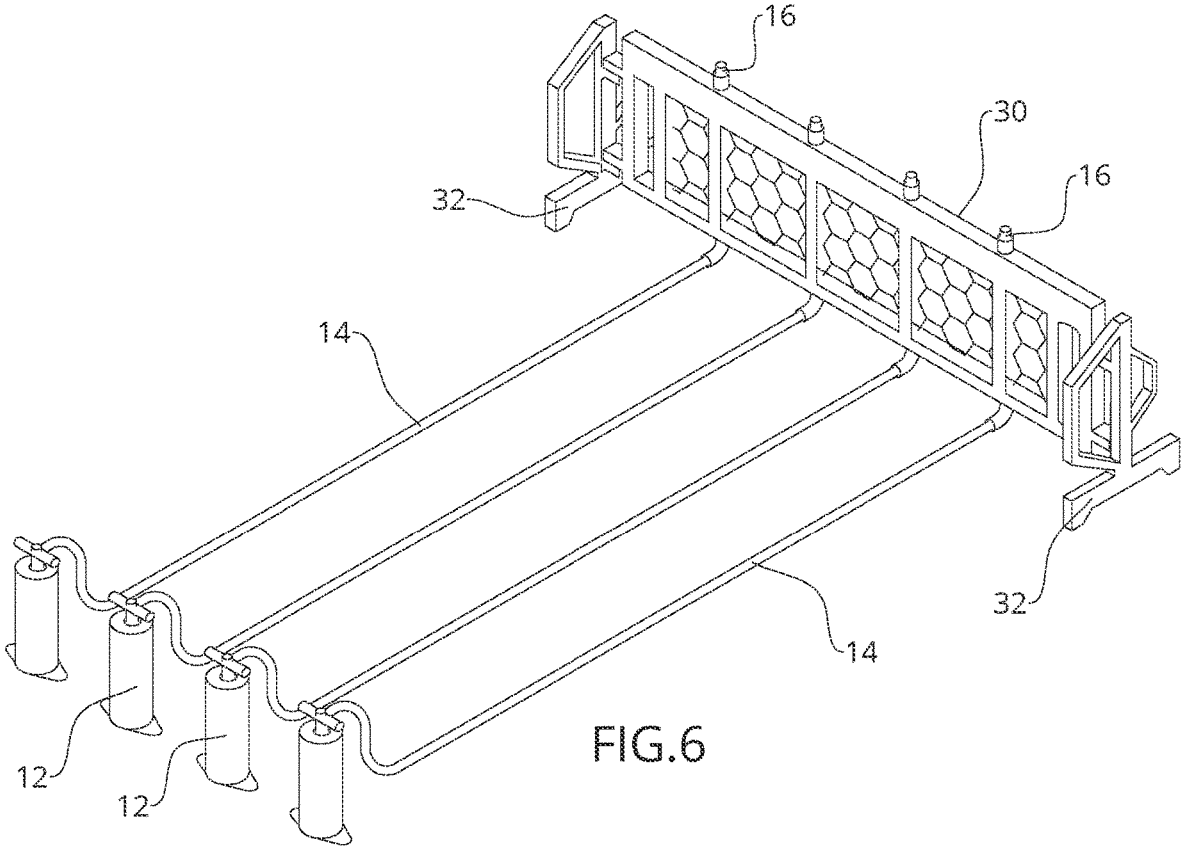
FIG. 6 is a perspective view of an exemplary embodiment of the present invention.
Figure 7:
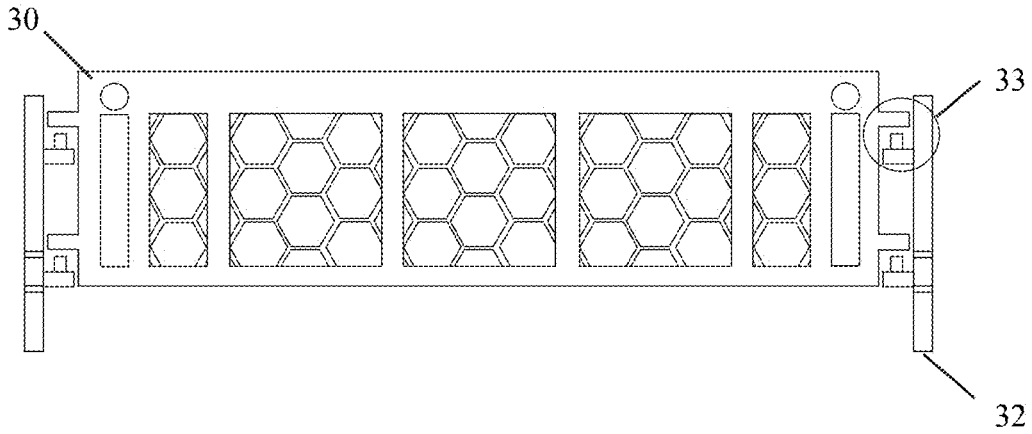
FIG. 7 is an elevation view of an exemplary embodiment of a balloon-burst frame apparatus 30 the present invention, illustrating hinge pin inserts 33.

Referring to FIGS. 1 through 7, the present invention provides a balloon busting frame apparatus 10 or 30 raised off the ground with two wide leg stands 11 or 32, respectively. Each balloon busting frame 10/30 has a plurality of inlet nozzles 17 and a plurality of outlet nozzles 16. Fluidly connected to each inlet nozzle 17, by way of a hose 14, is a pump 12 for urging airflow from the inlet nozzle 17 to a respective, and fluidly connected, outlet nozzle 16. The balloon busting frame apparatus 10 is equipped with a plurality of airway pipelines, wherein each airway pipeline has an end bracket 25 and a balloon socket positioned on each pipeline along the top section of the balloon busting frame apparatus 10.

Each outlet nozzle 16 is dimensioned and adapted to removably engage a balloon 18 by way of a quick-change adaptor 50. The quick-change adaptor 50 may be a barbed conduit 40 having a first raised flange 20 within the middle third of the length of the conduit. Just spaced apart from the first raised flange 20, along the barbed conduit 40, is a second raised flange 23, thereby defining a lock groove 22 between the first and second raised flanges 20 and 23.

A locking mechanism 60 is dimensioned and adapted to engage the inlet 19 of the balloon 18 and interconnect the balloon 18 to the lock groove 22 by way of an arcuate retainer 26. The locking mechanism 60 may include a cable tie 24 providing the arcuate retainer 26 that engages the lock groove 22. The cable tie 24 may have a flexible tape section with teeth that engage with a pawl in the head to form a ratchet so that as the free end of the tape section is pulled the cable tie tightens in a locked condition and does not come undone. The arcuate retainer 26 may extend orthogonally from a portion of the tape section that is inward of the pawl-head by approximately one quarter of an inch to one inch. The cable tie 24 may have a release mechanism 28 for moving from the locked condition to an unlocked condition to enable a quick-change functionality.

In one embodiment, the balloon busting frame 30 present invention may embody a game apparatus leg stands 32 with hinge pin inserts 33, wherein on a frame leg inserts into the frame receiving end. The hinge pin inserts 33 enable pivotable movement of the multiple airway balloon busting frame 30.

The present invention embodies a balloon bursting frame apparatus that can be made through the following steps. First, attach a plurality of nylon hose barb hose menders to the top of the frame apparatus. The barb hose menders may have a diameter selected from a group of diameters ranging from ¼ of an inch to one inch. Second, connect a Charlotte pipe 1-¼-in diameter schedule 40 PVC couplings for outer stability locking onto each hose mender.

Then the manufacturer may assemble the frame apparatus through connecting two Charlotte pipes 3-inch diameter×8-Ft pipes vertically for the top and bottom of the frame. Then use a bit to bore a plurality of holes. Then the manufacturer may attach two 16-inch pipes horizontally to form the right and left sides of the frame, followed by joining a plurality of Charlotte pipe 3-inch diameter 90-degree PVC/DWV street elbows to the top and bottom pipes to create corners. In one embodiment, the manufacturer may attach four Charlotte Pipe 1-inch Diameter×30-inch pipes to the elbows to create four airway pipelines. In this embodiment, the manufacture may secure eight Charlotte pipe 1-¼-in diameter schedule 40 PVC couplings to the inside of the frame for inner stability locking.

Then, the manufacturer may complete the bottom frame through the following steps: attach a plurality of Charlotte pipe 1-¼-in diameter schedule 40 PVC couplings to the bottom of the frame for stability; connect a plurality of ¾ diameter nylon hose barb hose menders to the couplings for attaching external airline tubes; secure four PVC 90 degree elbows, socket×1-¼-inch diameter to the hose menders; attach two Charlotte pipe 3-inch diameter PVC DWV sanitary tees to the bottom pipes for additional support.; place two 3 inch diameter flanges on top of the sanitary tees for stability; and position two 24-inch diameter ¾" high circular bases beneath the flanges to support the frame apparatus, before insert four ¾ clear inner tubing pieces along the inside of the frame—these tubes will support balloon nozzle adaptors.

It is understood that even though the Figures show four outlet nozzles the present invention contemplates frame apparatuses that have at least more than one outlet nozzle, such as two, three, four, five, etc.

The present invention addresses the challenges associated with traditional balloon burst toys by introducing a preloaded balloon nozzle adaptor and an enhanced balloon bursting game apparatus that allows for efficient and simultaneous participation of multiple users. The preloaded balloon nozzle adaptor simplifies the process of reloading balloons onto the nozzle, while the frame apparatus with its integrated airway pipelines, sockets, with inflatable pumps revolutionizes the overall experience of balloon bursting games. The present invention offers a comprehensive and practical solution that promises to elevate the enjoyment of balloon-related activities including easy preloaded balloon nozzle adaptors with a 4-airway balloon bursting frame apparatus, including by way of example only, the following gameplay:

Step 1: Divide your group into four even lines.

Step 2: The first person in each line will attempt to pop the balloon by pumping the attached inflater (four participants at simultaneously.

Step 3: On the signal "GO," participants will pump (Pull Handle Up/Push Handle Down) as fast as they can keeping both feet on the pump's straps until the balloon pops. Then, reload the easy preloaded balloon attachments that are designed for the apparatus by plugging the preloaded balloon nozzle attachments into each of the four airlines on the 4-way balloon apparatus. This will eliminate the delay when attaching the balloon to the nozzle for the next participant waiting to play. With the 4-way balloon bursting frame apparatus will allow a plurality of users and other participants to burst balloons simultaneously. After bursting their balloons, the preloaded adaptors can quickly be plugged into the balloon bursting frame apparatus in a matter of seconds. Users will be able to secure your balloon with the above-mentioned connection mechanisms.

Alternatively, the present invention embodying the balloon nozzle adaptor connector disclosed herein can be used to secure and repair hoses with a firm secure connection with the zip tie hose mender combination.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A balloon bursting game apparatus frame, comprising:

a frame having a top portion;

a plurality of outlet nozzles arranged along the top portion of the frame;

a plurality of air supply conduits connected to the frame and fluidly connected to the plurality of outlet nozzles; and a plurality of removable balloon adaptor assemblies, each adaptor assembly of the plurality of removable balloon adaptor assemblies being detachably coupled to a respective outlet nozzle;

wherein each adaptor assembly of the plurality of removable balloon adaptor assemblies comprises:

an adapter conduit having a barbed exterior surface configured to receive a balloon;

a first flange and a second flange spaced apart along the adapter conduit and extending radially outward beyond the barbed exterior surface to define a lock groove therebetween; and a locking mechanism configured to engage the lock groove and selectively secure and release the balloon relative to the adaptor assembly;

wherein air is supplied through fluid connection between the plurality of air supply conduits, the plurality of outlet nozzles, and the plurality of removable balloon adaptor assemblies into a plurality of balloons respectively attached to each adaptor assembly to allow the balloons to be simultaneously inflated for bursting.

* * * * *